United States Patent [19]

Lichti et al.

[11] 4,290,724

[45] Sep. 22, 1981

[54] CONVEYOR PAN IMMOBILIZING ASSEMBLY

[75] Inventors: Robert D. Lichti, 3318 Warwood Rd., Lakewood, Calif. 90712; Frederick D. Hock, Los Alamitos, Calif.

[73] Assignee: Park Mobile, Inc., New York, N.Y.; by said Frederick D. Hock

[21] Appl. No.: 107,328

[22] Filed: Dec. 26, 1979

Related U.S. Application Data

[63] Continuation-in-part of Ser. No. 873,520, Jan. 30, 1978.

[51] Int. Cl.[3] ..... E04H 6/14

[52] U.S. Cl. ..... 414/251; 198/796

[58] Field of Search ..... 414/233–235, 414/241, 242, 249–251, 253–255, 259, 260, 247, 248, 529, 535; 198/796–798, 800; 188/32, 111; 193/35 C

[56] References Cited

U.S. PATENT DOCUMENTS

| | | | |
|---|---|---|---|
| 2,645,367 | 7/1953 | Stabile . | |
| 2,773,609 | 12/1956 | Holappa . | |
| 2,794,559 | 6/1957 | Rowe . | |
| 2,817,446 | 12/1957 | Hodous . | |
| 2,856,081 | 10/1958 | Zaha . | |
| 3,185,330 | 5/1965 | Buckner . | |
| 3,424,321 | 1/1969 | Lichti | 198/795 |
| 3,510,014 | 5/1970 | Speaker et al. . | |
| 3,656,608 | 4/1972 | Lichti | 198/798 |

*Primary Examiner*—Robert W. Saifer

*Attorney, Agent, or Firm*—Larson, Taylor & Hinds

[57] ABSTRACT

A pair of conveyor pan immobilizing subassemblies are disclosed for engaging the opposite sides of a conveyor pan to stabilize the pan in a first direction transverse to the conveyed direction of the pan. In one embodiment, each subassembly is comprised of a plurality of pan engagement assemblies, each pivotally mounted for depression in a vertical axis by an off-centered pan, and each spaced further from the conveyor pan in the first direction, such that the pan is serially engaged by the assemblies as a result of pan movement resulting from, for example, loading or unloading of the pan. In another embodiment, the subassembly comprises a roller rotatably mounted for rotation by a pan being moved in the conveyed direction and resiliently mounted for depression by an off-centered pan. The roller is further mounted such that the surface thereof, when in engagement with the conveyor pan, forms an acute angle with a vertical axis, thereby resulting in a wedging engagement of the conveyor pan by both of the subassemblies' rollers.

7 Claims, 24 Drawing Figures

FIG. 18
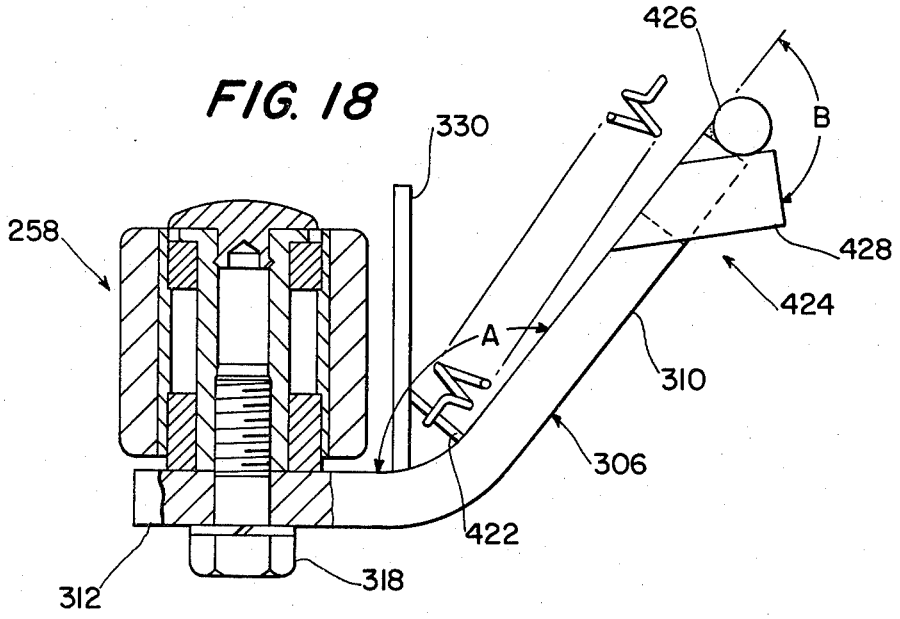
FIG. 19
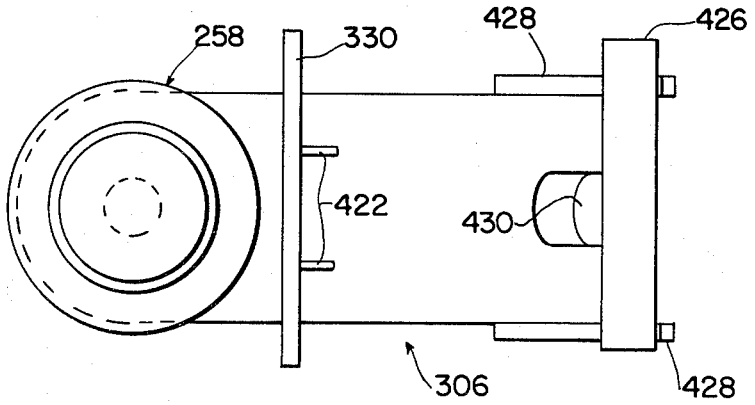
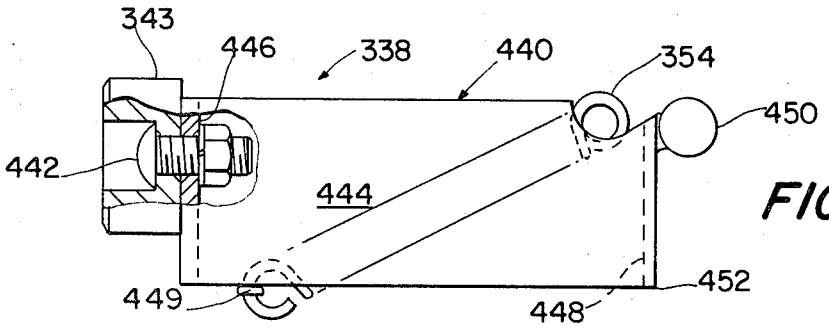
FIG. 20

CONVEYOR PAN IMMOBILIZING ASSEMBLY

CROSS-REFERENCE TO RELATED APPLICATION

This application is a continuation-in-part of patent application Ser. No. 873,520, filed Jan. 30, 1978.

FIELD OF THE INVENTION

The present invention relates to the stabilization of conveyor pans during the loading and unloading thereof and more particularly relates to an assembly for immobilizing the pans of an endless type conveyor when the pans are at the loading/unloading station. In one embodiment of the invention, the invention relates to stabilizing rollers for stabilizing pivotally suspended, individual cradles carried by a vertical endless conveyor when the cradles are positioned at the loading-/unloading station.

BACKGROUND OF THE INVENTION

Large, endless vertical conveyors which transport a plurality of cradles or pans from a loading/unloading station to storage locations require that the pan be maintained in a uniform orientation while transisting around the conveyor path. This is only possible if the conveyor pans are pivotally mounted to the conveyor chains, as disclosed in U.S. Pat. Nos. 2,773,609 to Holappa and 3,656,608 to Lichti. One resulting disadvantage of the pivotal support system is that the conveyor pans and their supporting arms must have a great deal of play and must be capable of flexing a number of inches in any direction. While this amount of play has no adverse effect when the pans are in a storage position, this amount of play cannot be tolerated when the pan is in the loading/unloading position. In this regard, it is noted that conveyors of the type disclosed in the two aforementioned patents are for simultaneously storing 20 to 30 objects or more that are as big as automobiles. Exemplary specifications for a conveyor having this type of capacity include a height of over 85 feet and a weight of 44 tons. These conveyors typically can store a total weight of over 33 tons with each conveyor pan capable of holding over 3,000 pounds.

A conveyor of the aforedescribed magnitude which transports a load such as an automobile from a storage position into the loading/unloading position must have sufficient tolerances at the loading/unloading position to permit a loaded pan to swing and to yaw, pitch, and roll as the pan is conveyed into the loading/unloading position in order to prevent damage to the conveyor supporting structure. On the other hand, when automobiles are driven onto or off a conveyor pan, there must either be small clearances between the conveyor pan and the loading/unloading platform or the pan has to be stabilized or immobilized at the loading/unloading location.

In an automobile parking tower similar to the type depicted in the aforementioned Lichti patent and also depicted with different improvements or in different embodiments in the following U.S. Pat. Nos. 3,278,052; 3,424,321; 3,547,281; and 3,627,110 to Lichti; a very simple, rotatably mounted hemispherical steel bumper or roller which had a vertical axis of rotation was employed on either side of the conveyor pan. A pan conveyed to the loading/unloading position, was stopped in between and spaced from the two rollers. When an automobile was driven onto a pan, the pan would deflect and bang up against the forward roller. In the course of the automobile moving onto the pan and leaving the pan, the pan typically would oscillate back-and-forth a number of times striking the front and rear rollers. This not only resulted in a very noisy operation, it also seriously dented the edges of the pan. In addition, because of considerable play between the pan and the rollers, during conveyance of the pans, the pans would typically bang against one or the other roller when entering and leaving the loading/unloading station.

Other, unsuccessful attempts to satisfactorily immobilize conveyor pans can be found in several United States patents. In U.S. Pat. No. 2,645,367 to Stabile, two slide plate members 121 are suspended by springs 122 from the floor of the apparatus and provide balance as the conveyor pans or carriers 48 slide therealong. Since plates 121 do not engage the sides of carrier 48, no lateral stability is provided to the carriers when they are in the loading/unloading position. The aforementioned Holappa Patent does not even disclose a pan stabilizing means though it is conceivable that spring-biased wheels 112 on car pan 44 might steady the pan. However, the principal purpose of wheels 112 is to lower the ramp from the pan on engagement of wheels 112 with the ground.

A different approach to solve the problem of pan stability in the loading position is disclosed in the Hodous U.S. Pat. No. 2,817,446 and the Zaha U.S. Pat. No. 2,856,081 in which each pan is provided with rollers or wheels which may engage side rails. By using stabilizing means on each pan, this approach is redundant and very costly, and yet it still does not provide a quiet operation.

In some installations, it is necessary for the pan not only to be stabilized quickly, but also to be substantially coplanar with the approach ramp when stabilized. This requirement necessitates that if pan end stops are used, they be located below the top surface of the approach ramp.

In summary, none of the aforedescribed prior art devices provide an effective, quiet, inexpensive, simple, maintenance-free immobilizing means for a conveyor pan when the pan is stationary and being loaded, yet can be easily knocked out of the way when the conveyor is operating and the conveyor pans are moving past it.

SUMMARY OF THE INVENTION

The present invention provides a conveyor pan immobilizing means which is very inexpensive, not redundant, and quite simple in design. A conveyor pan can be effectively immobilized and prevented from moving in the direction of loading when located at the loading/unloading station, yet is free to move in the conveyed direction without disengaging the immobilizing means. In essence, the present invention provides a means for locking the pan such that the harder the pan is pushed in the locked direction the firmer the pan is held.

The present invention employs two rotatably mounted rollers which are also resiliently mounted for movement in a substantially vertical direction. The surface of the roller is slanted with respect to the pan and thus acts as a simple wedge. After only very slight movements of the pan, the rollers wedge solidly on either side of the pan holding it securely. On the other hand, as a result of the conveyor tolerances and the play in the pan in a direction transverse to the pan movement, a pan can be conveyed off center to the loading-/unloading station and land on top of one of the rollers.

As a result of the roller being resiliently mounted, the roller will simply be depressed out of the way. During loading and unloading of the pan, the resulting pan movement will uncover the slanted roller which will then engage the pan side and together with the other roller lock the pan securely in place. On the other hand, the pan can easily be conveyed away from the loading-/unloading station without any opposition from the rollers as a result of their being rotatably mounted and resiliently mounted in the vertical direction.

Other features and objects of the present invention will be set forth in, or apparent from, the accompanying drawings and the detailed description of the preferred embodiments found hereinbelow.

BRIEF DESCRIPTION OF THE DRAWINGS

FIG. 6E is a table identifying the different parts of one embodiment of the present invention and a legend identifying the symbols used to indicate the positions of the respective elements.

FIG. 18 is a side elevational view to scale, partly in cross-section, of the roller assembly of FIG. 16.

FIG. 19 is a top plan view to scale of the roller assembly, depicted in FIG. 18, but with the springs removed.

FIG. 20 is a side elevational view to scale, partly in cross-section, of the bumper assembly depicted in FIG. 16.

DETAILED DESCRIPTION OF THE PREFERRED EMBODIMENTS

Figure 1:
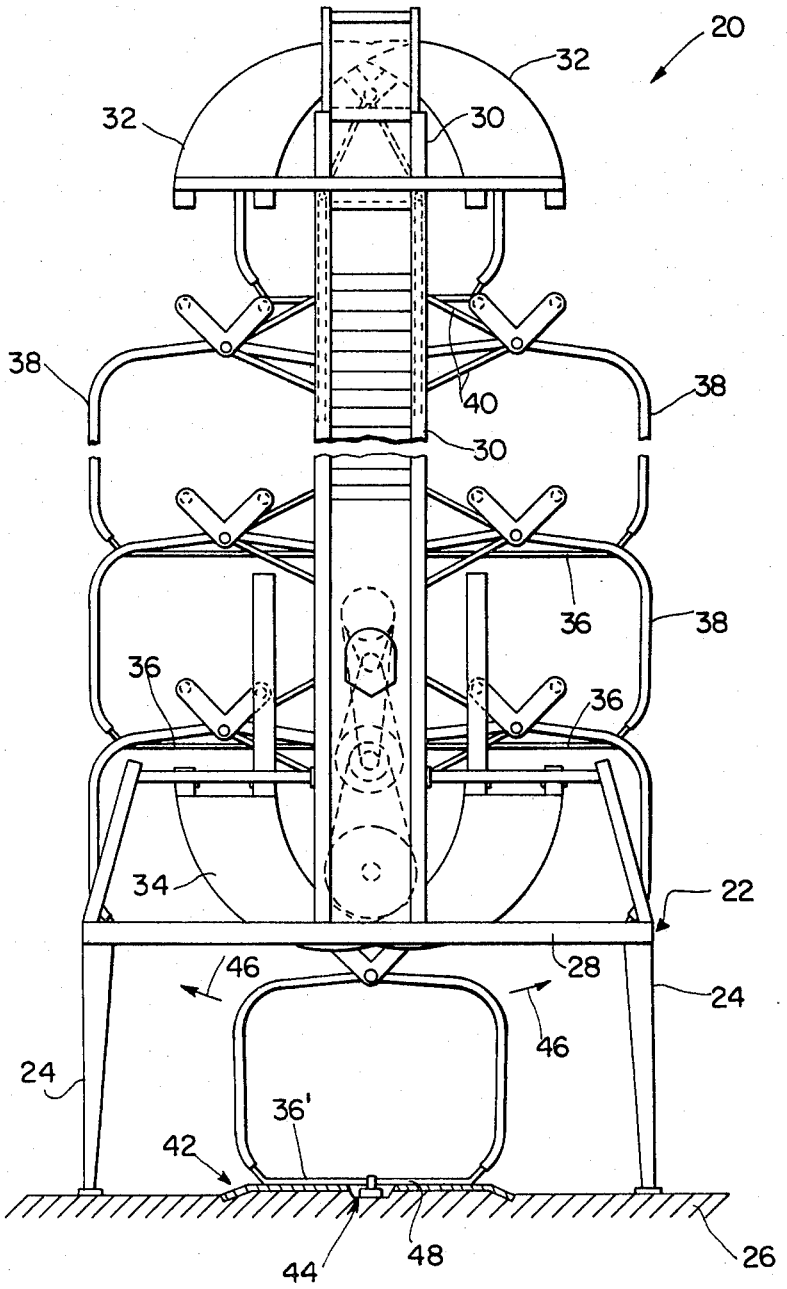
FIG. 1 is an end elevational view of a storage tower incorporating a vertical endless conveyor which includes a plurality of conveyor pans and incorporating a conveyor pan immobilizing assembly at the bottom, loading/unloading position.

With reference now to the figures wherein like numerals depict like elements throughout the several views, a vertical conveyor storage device capable of storing large objects such as automobiles and which incorporates a pan immobilizing assembly according to the present invention is depicted at 20. Storage device 20 is only generally described and reference is made to the aforementioned Lichti U.S. Pat. No. 3,656,608 for greater details thereof. Generally, storage device 20 is comprised of a frame 22 that includes legs 24 for supporting storage device 20 above the ground surface indicated at 26, bottom girders 28 which supports two, spaced apart chain housings 30, only one of which is shown, and an upper and lower track assembly 32 and 34, respectively. Chain housing 30 is of such construction that it not only accommodates an endless chain, but also serves as a main frame extending upwardly from bottom girder 28 to a point adjacent the top of storage device 20.

A plurality of platforms or cradles or conveyor pans 36 are provided with diagonal struts 38 at each end thereof and is connected to and hung from the chain with a plurality of support arms 40. Each individual coonveyor pan 36 is supported at opposite ends on the opposite endless chains, one pan equally spaced above and below the next adjacent pans and extending entirely around both vertical sides of chain housing 30 in such a fashion that the lowermost pan 36' can be positioned on ground surface 26 at a loading/unloading station generally indicated at 42. Also located at loading/unloading station 42 is a conveyor pan immobilizing assembly 44 according to the present invention and comprised of two substantially identical subassemblies located on either side of conveyor pan 36' and only one of which, 44' is shown.

As depicted in FIG. 1, lowermost conveyor pan 36' can be rotated away from loading/unloading station 42 in either generally horizontal direction indicated by arrows 46. Conveyor pan 36' is loaded in a direction perpendicular to its movement which, as depicted in FIG. 1, is into and out of the drawing. Therefore, it can be seen that pan immobilizing assembly 44 immobilizes movement of conveyor pan 36' in a direction substantially perpendicular to the movement thereof yet permits movement of conveyor pans 36' in the conveyed direction indicated by arrows 46. Each pan immobilizing subassembly 44' respectively engages a side 48 of conveyor pan 36' that is substantially parallel to the conveyed direction. In this way, pan immobilizing assembly 44 immobilizes lowermost pan 36' located at loading/unloading station 42 in a direction transverse to arrows 46 indicating pan movement while permitting conveyor pan 36' to be conveyed away from loading-/unloading station 42.

Figure 2:
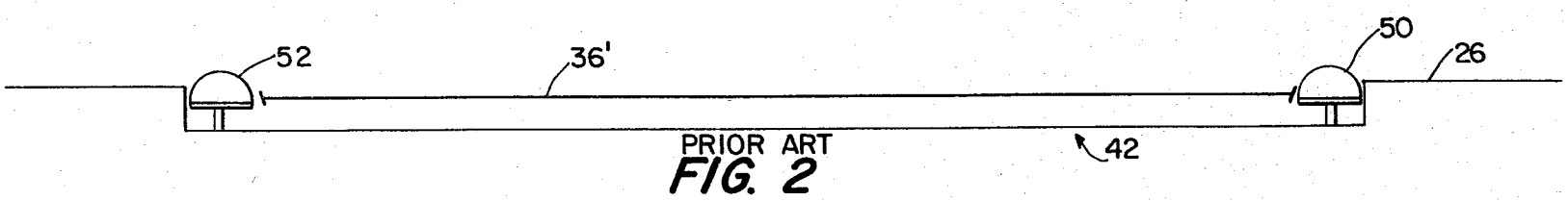
PRIOR ART FIG. 2
FIG. 2 is a diagrammatic, end view of a prior art roller unsuccessfully used to stabilize a conveyor pan.
Figure 3:
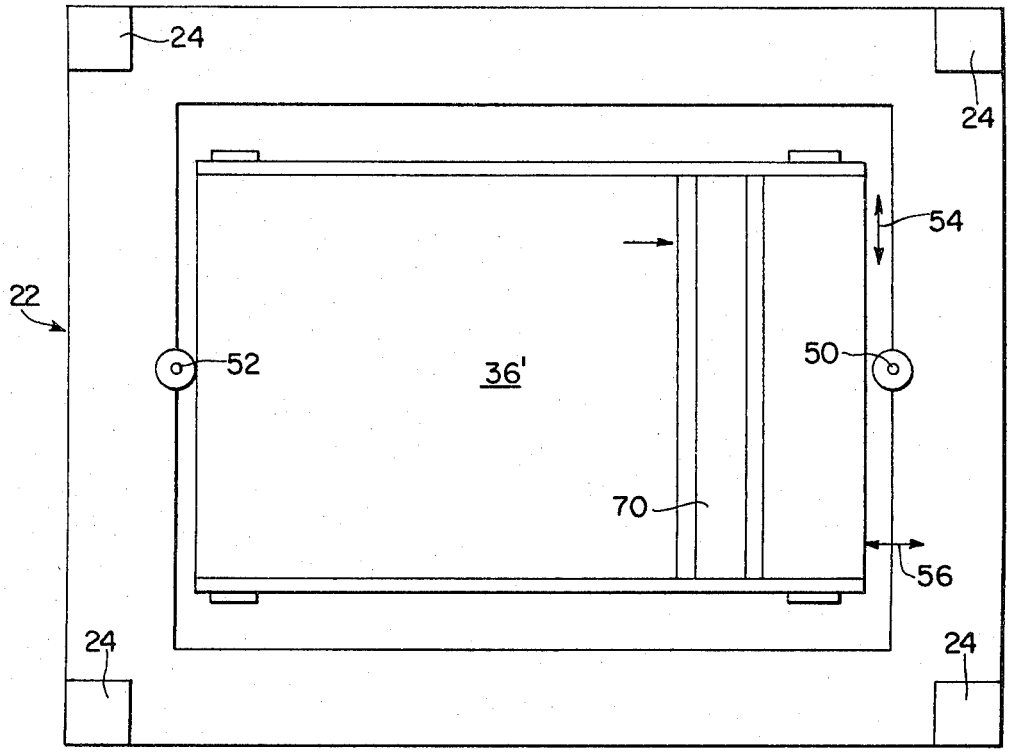
PRIOR ART FIG. 3
FIG. 3 is a diagrammatic, top plan view of the conveyor and the prior art conveyor pan stabilizing roller depicted in FIG. 2.

A prior art bumper system used with the storage device depicted in FIG. 1 is shown in FIGS. 2 and 3. The bumper assembly consists of two, rotatably mounted, slanted steel rollers 50 and 52 respectively located on either side of conveyor pan 36' when positioned in loading/unloading station 42. As clearly seen in FIG. 3, conveyor pan 36' is conveyed into and out of loading/unloading station 42 in the direction indicated by arrow 54. On the other hand, conveyor pan 36' is loaded with, for example, an automobile (not shown) driven onto conveyor pan 36' in a direction indicated by arrow 56. As the automobile travels into pan 36', pan 36' deflects and bangs up against forward bumper 52. Pan 36' often would then ricochet off bumper 52 and strike bumper 50. Typically, as an automobile moves onto and leaves conveyor pan 36', conveyor pan 36' would bang back and forth a number of times against the forward and rearward bumpers 52 and 50. Also, as a result of considerable play between conveyor pan 36' and bumpers 50 and 52, conveyor pan 36' would strike against one or the other bumper when storage device 20 was operating to convey conveyor pans 36.

Figure 4:
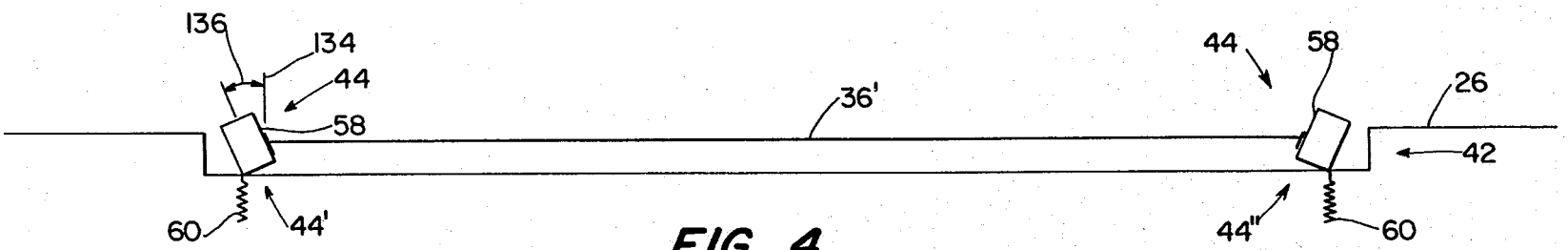
FIG. 4 is a diagrammatic, end view of a conveyor pan stabilizing means according to the present invention and drawn in a view similar to that depicted in FIG. 2 for comparison purposes.
Figure 6E:
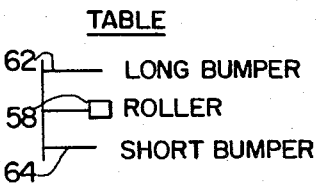
FIGS. 6A–6E are schematic views showing different positions which a conveyor pan can initially assume with respect to a pan stabilizing means according to one embodiment of the present invention.
Figure 6C:
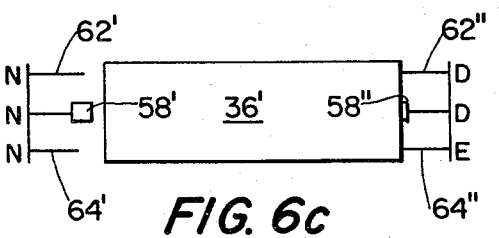
Figure 6D:
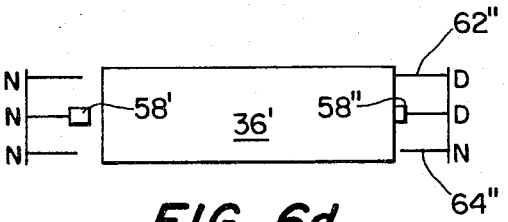
Figure 6A:
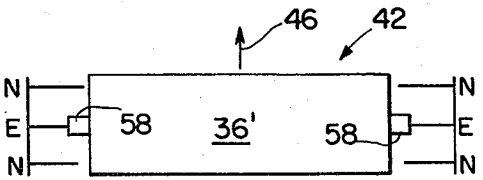
Figure 6B:
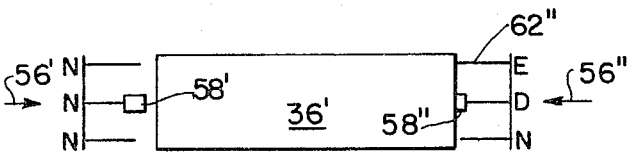
Figure 5:
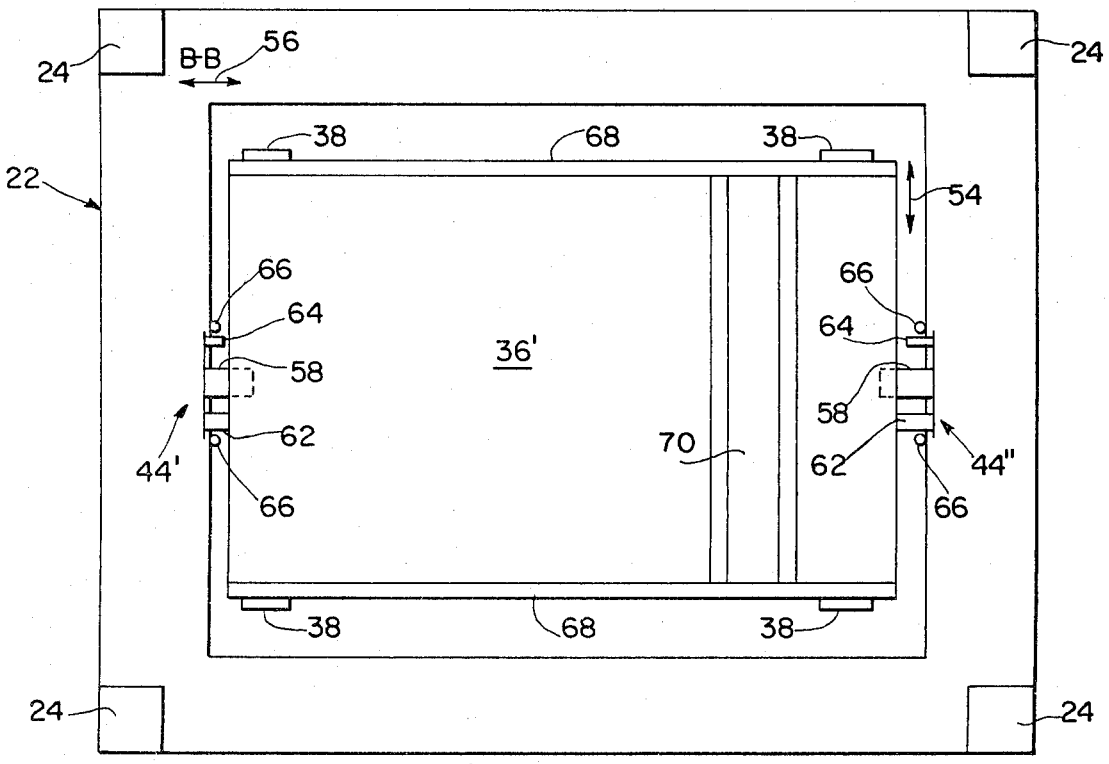
FIG. 5 is a diagrammatic, top plan view depicting a conveyor pan engaged by a pan immobilizing means according to one embodiment of the present invention and drawn in a view similar to FIG. 3 for comparison purposes.

With reference now to FIGS. 4 and 5, a pan immobilizing assembly according to the present invention is depicted in engagement with conveyor pan 36' on either side thereof. In this embodiment of the invention, pan immobilizing assembly 44 is comprised of first and second subassemblies 44' and 44" that are substantially the same except for a mirror reversal of the components. Subassemblies 44' and 44" each comprise a slanted, rotatably mounted roller 58 and a means for resiliently mounting roller 58 for movement in the substantially vertical direction such as a spring 60. For those conveyors in which the operating tolerances are greater and the exact location of a conveyed pan to the loading/unloading station can vary significantly, the pan immobilizing subassembly can further be comprised of a plurality of bumpers variously spaced transversely from pan 36'. As shown diagrammatically in FIG. 5, each subassembly can include a long depressable bumper 62 located on one side of and further from pan 36' than roller 58, a short depressable bumper 64 located on the other side of roller 58 and spaced further from pan 36' than long bumper 62, and two fixed bumpers 66 spaced transversely furthest from pan 36' and located outwardly of long and short bumpers 62 and 64.

For the purposes of explanation, it is noted that conveyor pan 36 is typically made from thick gauge sheet metal with upstanding sides 68 and an open front and back. The pan is typically supported at each of the four corners by struts 38 (as shown in FIG. 1) and may have provisions for retaining an automobile therein, such as wheel wells 70 (as shown in FIGS. 3 and 5). A conveyor storage device with conveyor pans 36 such as that generally described in FIG. 1 has been sold and displayed in the United States since at least as early as 1970. Therefore, such a device is well-known to one of ordinary skill in the art and it is not believed necessary to include a further description of the device herein.

Figure 9:
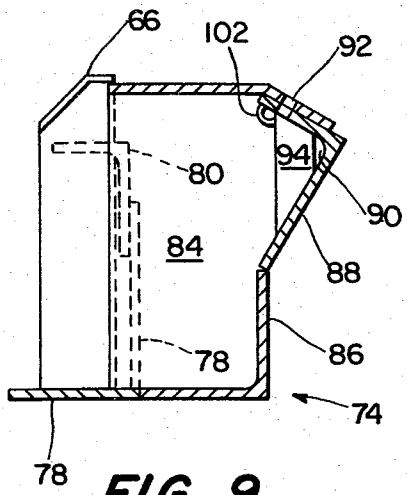
FIG. 9 is a cross-sectional view to scale, with parts removed, taken along lines 9—9 of FIG. 8.
Figure 8:
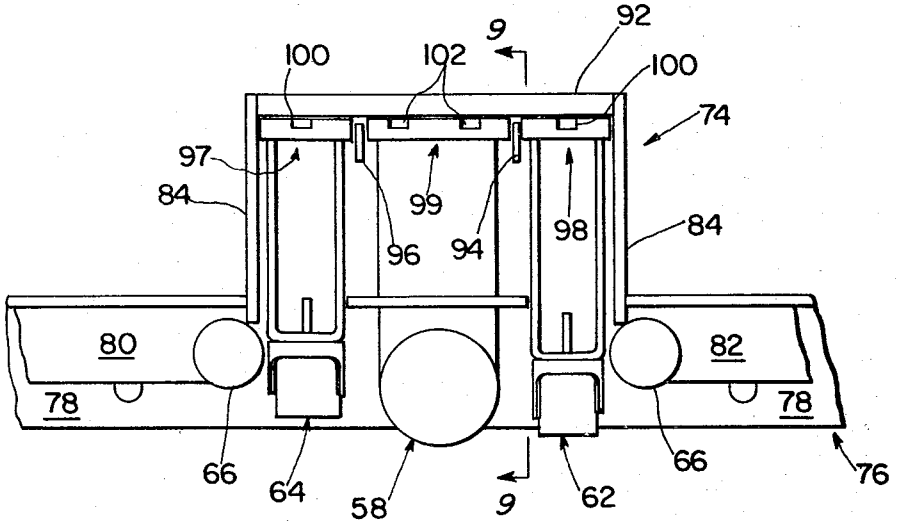
FIG. 8 is an enlarged, plan view to scale with the housing cover removed and taken along lines 8—8 of FIG. 7.
Figure 7:
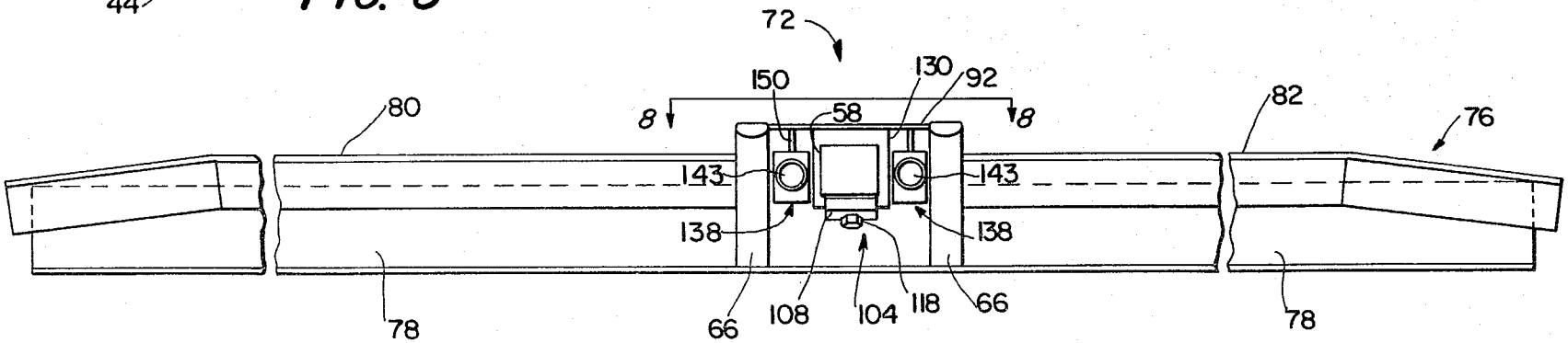
FIG. 7 is an elevational view to scale of a conveyor pan immobilizing subassembly.

Because both pan immobilizing subassemblies 44' and 44" are substantially similar except for obvious differences as a result of the subassemblies being on opposite sides of pan 36, only subassembly 44' will be described in greater detail. With reference now to FIGS. 7, 8, and 9, subassembly 44' comprises a centrally located pan engaging portion 72 which includes a housing 74 in which roller 58, long bumper 62 and short bumper 64 are located, and a frame 76 that is used to rigidly attach subassembly 44' to the edge of loading/unloading station 42, as shown in FIG. 1. Frame 76 is comprised of a side channel 78 extending substantially the entire length of frame 76 and preferaby comprised of a metal angle iron which has exemplary dimensions of nine feet-nine inches long by five inches high by three-and-a-half inches wide. A central portion of the vertical part of side channel 78 is removed for receiving housing 74 therebetween and which is welded thereto. Two top angles 80 and 82 extend from either side of housing 74 and can similarly, for example, comprise angle irons. An end portion of each top angle 80 and 82 is bent so that frame 76 can conform to a built up portion of ground 26 at loading/unloading station 42 (as shown in FIG. 1). As is evident from FIGS. 7 and 8, fixed bumpers 66 are welded to the bottom of side channel 78 and to the inner end of the top of top angle 80, which has been cut to fit around bumper 66, as shown in FIG. 8.

With particular reference to FIGS. 8 and 9, housing 74 is comprised of sides 84, a lower angle iron 86 which forms the bottom and lower back of housing 74; an upper angle iron 88 welded to lower angle iron 86 and angled rearwardly therefrom so as to form a pocket 90; and a removable top 92. Two bars 94 and 96 are welded between the sides of upper angle iron 88 so as to divide pocket 90 into three sections, end sections 97 and 98 and a central section 99. Centrally located in each end section 97 and 98 and rigidly welded to or otherwise fastened to the top portion of upper angle iron 88 is a half-round staple 100. In addition, two half-round staples 102 are rigidly welded in a similar position onto upper angle iron 88 in central section 99. Preferably, all of the components of housing 74 are welded to each other so as to form an integral structure. Alternatively, as is obvious to one of ordinary skill in the art, housing 74 can be manufactured in other ways as by being cast in a single piece.

Figure 10:
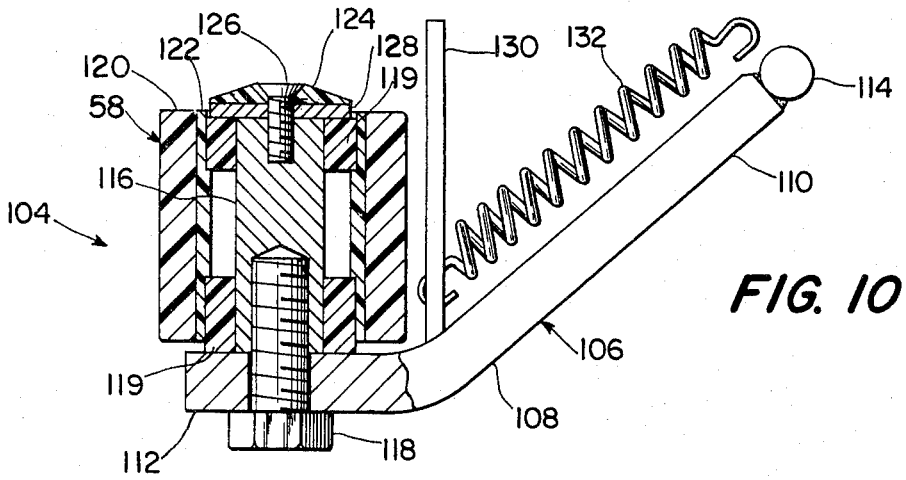
FIG. 10 is a side elevational view, partly in cross section, of the main roller assembly.
Figure 11:
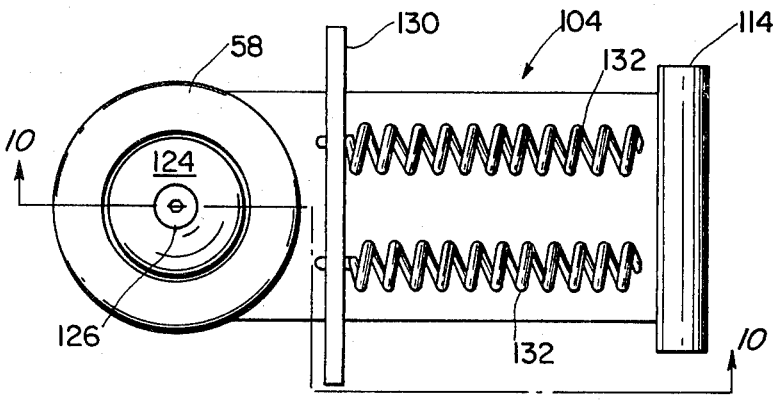
FIG. 11 is a top plan view to scale of the roller assembly depicted in FIG. 10.

With reference to FIGS. 10 and 11, a roller assembly 104, comprising roller 58 rotatably mounted on a bracket 106 is depicted. Bracket 106 is comprised of a flat bar 108 having a bend therein near one end thereof so as to provide a longer first portion 110 and a short second portion 112, and a transversely extending rod 114 rigidly mounted to the distal end of longer first portion 110, for example, by being welded thereto, and extending slightly beyond the sides thereof. A bearing shaft 116 is rigidly, perpendicularly mounted to bar second portion 112 of bracket 106 with a bolt 118. Two solid bearings 119 preferably made of DELRIN (the trademark for a type of acetal resin) are rigidly mounted at each end of roller 58 and rotatably mounted to bearing shaft 116. Roller 58 is preferably a pallet roller that is comprised of a slightly resilient, hard rubbery outer cylinder 120 preferably made from ADIPRENE (the trademark for a type of polyurethane) and an inner concentric lining 122 preferably made from steel. Located above roller 58 is a roller cap 124 rigidly mounted on the top of bearing shaft 116 with a screw 126 and washer 128. Roller cap 124 is preferably a beveled, solid DELRIN bumper which has the purpose of protecting roller 58 from being struck by the bottom of an off-centered conveyor pan 36 and which is provided with a slanted top surface so that roller assembly 104 can be easily deflected downwardly by conveyor pan 36. Screw 126 retains roller cap 124 on bearing shaft 116. An upstanding plate 130 is rigidly mounted at the bend of flat bar 108 and extends upwardly beyond roller cap 124. Plate 130 serves as an anchor for springs 132 and as a stop to rest the roller assembly 104 against the housing top 92 (FIG. 9).

Roller assembly 104 is resiliently mounted inside housing 74 with two coiled springs 132, the ends of which are attached to plate 130 through holes provided at the bottom thereof and the other ends of which are attached to corresponding staples 102. Roller assembly 104 is pivotally mounted in housing 74 as a result of springs 132 forcing rod 114 of bracket 106 into pivotal engagement with pocket 90. With bracket 106 resiliently mounted in housing 74, springs 132 urge roller assembly 104 upwardly until plate 130 engages housing top 92 thereby limiting further upward pivoting of bracket 106. At this position (as diagrammatically shown in FIG. 4), as a result of the shape and dimensions of bracket 106, the height of plate 130 and the location of pocket 90 and top 92 of housing 74, the surface of roller 58, and hence its axis of rotation since it is a cylindrical roller, forms an acute angle 136 with a vertical axis 134. Rollers 58 provide the best wedging effect on conveyor pan 36' when angle 136 is between 5° and 30° and is preferably, approximately 15°. At this angle, it is noted that the surface of roller 58 forms an obtuse angle with pan 36'.

Alternatively, instead of pivotally mounting a cylindrical roller so that the aforementioned optimal angle 136 is obtained, roller 58 can have a vertical axis of rotation, have a truncated conical shape, and be resiliently mounted in the vertical direction. However, roller assembly 104 with its aforedescribed mounting, offers several advantages over this other embodiment. These advantages include a relatively simple roller assembly design and housing design, easy and fast removal of a worn or damaged roller 58 or roller assembly 104, easy installation of pan immobilizing assembly 44; and a highly efficient and highly reliable roller and conveyor pan engagement. In addition, housing 74 can be easily kept relatively clean, can be easily cleaned, and even if congested with a fairly large amount of debris will still permit engagement of roller 58 with pan 36. In this regard, it is noted that a conically shaped roller would have to be resiliently mounted directly below the edge of conveyor pan 36 inside an essentially open well. Such an arrangement can be easily fouled with debris and is difficult to clean.

In one exemplary embodiment of roller assembly 104, roller 58 has a height of three inches and a diameter of three-and-a-quarter inches, plate 130 is four-and-a-half inches high, and bracket bar 108 has a three-and-a-half inch second portion 112 and a six inch first portion 110 that is displaced 43° above the horizontal.

Figure 14:
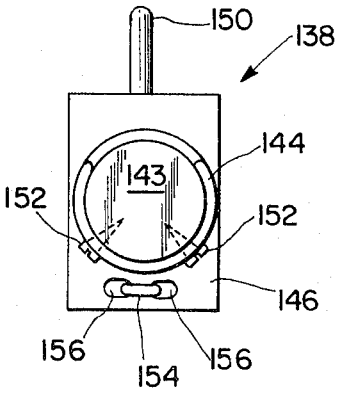
FIG. 14 is an end view to scale of the bumper assembly shown in FIG. 12.
Figure 12:
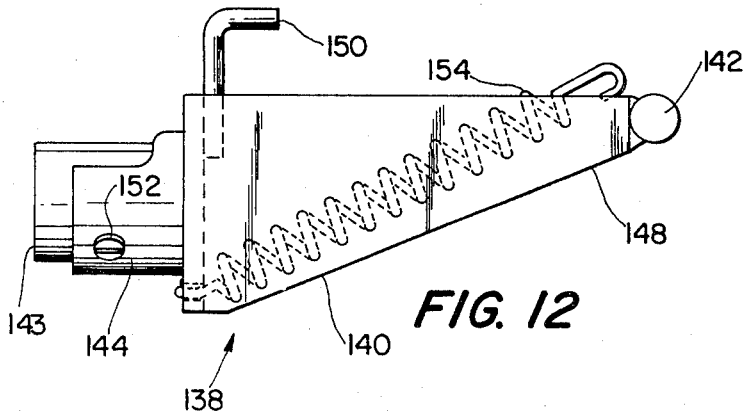
FIG. 12 is a side elevational view to scale of one of the bumper assemblies.
Figure 13:
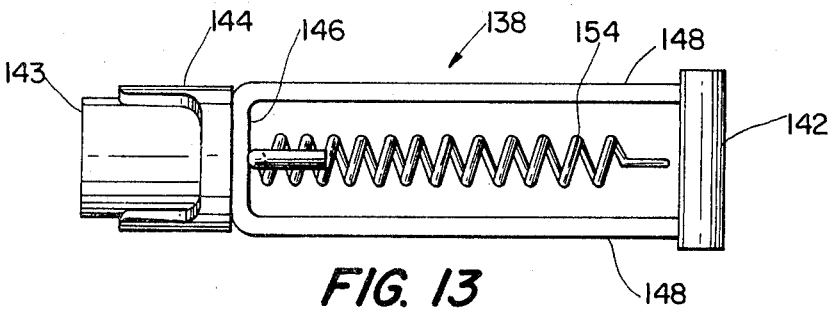
FIG. 13 is a top plan view to scale of the bumper assembly depicted in FIG. 12.

With reference to FIGS. 12, 13 and 14, a bumper assembly 138 is depicted. Except for the overall longitudinal length, long bumper 62 is identical with short bumper 64 and therefore only one need be described. Bumper assembly 138 is comprised of a frame 140, a rod 142 rigidly mounted at one end of frame 140 for pivoting in a corresponding pocket 90 in housing 74, and a bumper 143 preferably made from ADIPRENE mounted to frame 140 with bumper mount 144. Frame 140 consists of a single metal plate that has been bent into a U-shape and which is shaped so as to form a rectangular front 146 and two substantially identically shaped sides 148. Side 148 is essentially a truncated right triangle with an upward, rearward sloping hyoptenuse. An upward limiting stop 150 consisting of an inverted L-shaped rod, is rigidly mounted to front 146 of bumper assembly frame 140 and extends thereabove. Bumper mount 144 is a hollow cylinder having a portion of the top removed so that bumper 143 can be easily inserted therein, and provided with two orifices on either side near the bottom thereof for receiving corresponding screws 152 which removably, rigidly mount bumper 142 inside mount 144. Two orifices 156 are provided near the bottom of front 146 of bumper assembly frame 140 for receiving one end of spring 154. The other end of spring 154 is attached to the corresponding staple 100 located on housing 74.

Bumper assembly 138 is resiliently maintained in a vertical position as a result of spring 154 and the engagement of stop 150 with the top 92 of housing 74 in a manner similar to roller assembly 104, described hereinabove. In this position, bumper 143 can engage the side of conveyor pan 36' (as shown in FIG. 5) thereby preventing any further movement in that direction. On the other hand, should pan 36 be off-centered, bumper assembly 138 can be easily depressed by pan 36' and resiliently returned to its normal position upon the movement of pan 36 away from bumper assembly 138. Bumper assembly 138 can have exemplary overall lengths of eight-and-a-half inches for a long bumper and eight inches for a short bumper.

As seen in FIG. 8, pan immobilizing subassembly 44' has fixed bumpers 66 located the furthest from the side of conveyor pan 36. Roller 58 extends the furthest away from housing 74 and hence is the closest to the side of pan 36. Long bumper 62 and short bumper 64 fall in between these two extremes. Exemplary spacing of the outermost portions of the bumpers from the outermost portion of roller 58 are three-eights of an inch for long bumper 62, three-quarters of an inch for short bumper 64, and an inch-and-a-half for fixed bumpers 66. Naturally, these dimensions depend upon the operating tolerances of the particular conveyor device 20 and can very with every different device.

The operation of pan immobilizing assembly as depicted in FIGS. 5 through 14 with an exemplary vertical conveyor device 20 can best be explained with reference to FIGS. 6*a* through 6*e*. If conveyor device 20 were perfectly aligned so that the conveyor pan 36 was accurately delivered to loading/unloading station 42, and assuming roller 58 and the bumpers of pan immobilizing assembly 44 had the proper lengths, conveyor pan 36 would equally engage rollers 58 and be wedged therebetween, as shown in FIG. 6*a*. In such an example, none of the bumpers would be engaged. Then, as pan 36' was conveyed away from loading/unloading station 42 in the direction of arrow 46, rollers 58 would be rotated about their axis of rotation and, at the same time, be deflected downwardly and out of the way with very little noise. On the other hand, with reference to FIG. 6*b*, conveyor pan 36' was off-centered slightly to the right as shown in the figure such that the bottom of pan 36' has engaged roller cap 124, thereby depressing roller 58'' and knocking it out of the way. In the example shown in FIG. 6*b*, conveyor pan 36' was slightly off center such that long bumper 62'' was engaged by the side of conveyor pan 36'. If a load, such as an automobile, was then placed on conveyor pan 36' in the direction of 56'', further movement to the right would be prevented by engaged bumper 62''. On the other hand, if an automobile were driven in the direction of arrow 56', pan 36' will react and move in the direction of disengaged roller 58'. As soon as pan 36' has moved the very little amount necessary to uncover depressed roller 58'', the roller will pop up and the top thereof will engage the side of pan 36', thereby preventing any further movement of the pan toward roller 58''. Continued movement of pan 36' toward roller 58' will result in a wedging engagement of both sides of pan 36, as shown in FIG. *6a*.

FIGS. *6c* and *6d* show two other possibilities of the positioning of pan 36'. In FIG. *6c* both long bumper 62'' and roller 58'' have been depressed and short bumper 64'' has been engaged, thereby limiting further pan movement in that direction. FIG. *6d* shows both long bumper 62'' and roller 58'' being depressed with no contact with short bumper 64''. In this figure, pan 36' can move in either direction. As mentioned above, it is also possible for a greatly misaligned conveyor pan to depress roller 58 and both depressable bumpers 62 and 64. In this case, fixed bumpers 66 (not shown in FIG. 6) would prevent further movement of conveyor pan 36. The noticeable banging of conveyor pan 36' against a fixed bumper 66 will readily inform an operator of the conveyor device 20 that the device is misaligned since in the normal operation of the storage device, the engagement, disengagement, and depression of roller 58 and bumpers 62 and 64 is substantially quieter.

Proper positioning of pan immobilizing subassemblies 44' and 44'' will provide the condition that only one roller 58 can be depressed at a time. Once a roller is in contact with the side of the conveyor pan, it will remain in contact therewith.

Figure 15:
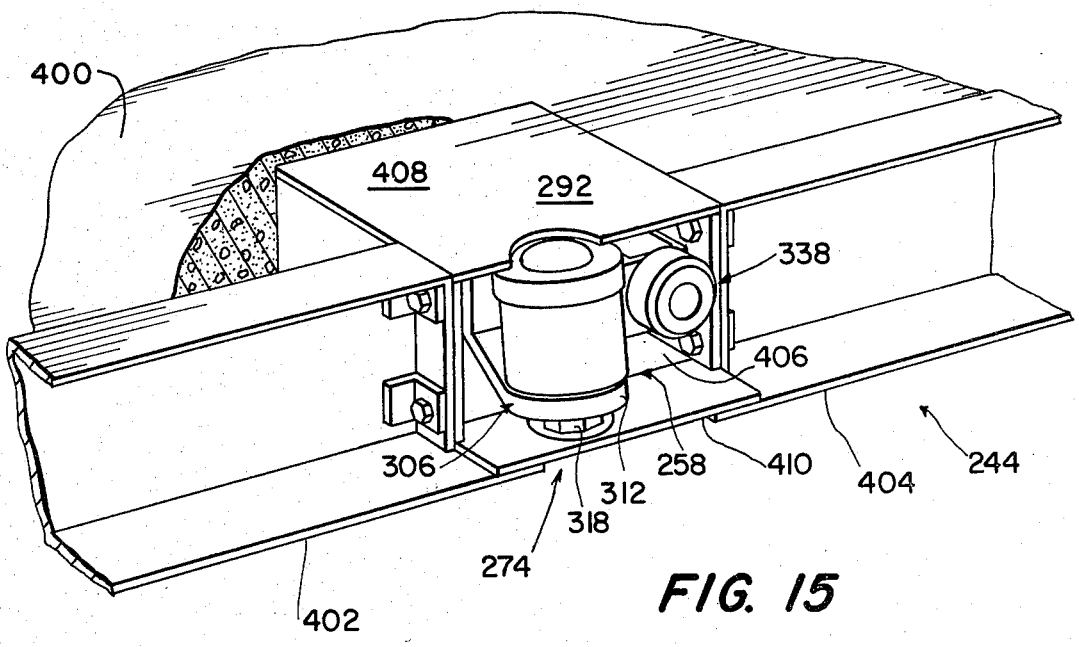
FIG. 15 is a perspective view of another embodiment of the pan end stop.

Referring now to FIG. 15, a modified roller/bumper subassembly 244 is depicted wherein the elements that are similar to the elements of subassembly 44 are denoted with numerals having a value exactly 200 times greater than the value of the numerals in subassembly 44. One advantage of modified subassembly 244 is that the maximum vertical height attained by the top of roller 258 is substantially level with the surface of an approach ramp 400. Top 292 of housing 274 is also substantially level with approach ramp 400. Thus flat bottom containers to be stored in the conveyor storage device 20 of FIG. 1 can be slid directly onto a positioned pan 36 or small motorized cargo trucks pulling a wide load, such as an automobile, can be driven directly over roller 258.

A further modification of subassembly 244 of subassembly 44 (depicted in FIGS. 7 and 8) is that the various parts are bolted together, thereby allowing for easier transportation of the disassembled parts and their faster installation. This modification also permits easier disassembly of an erected pan immobilizing assembly.

Figure 16:
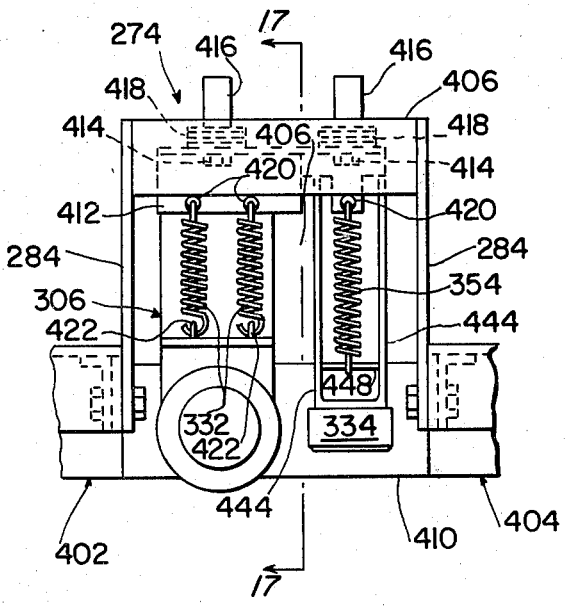
FIG. 16 is a top plan view to scale of part of a roller/-bumper subassembly similar to the one depicted in FIG. 15.

Pan immobilizing assembly 244, as shown in FIG. 15, includes a slanted L-shaped bracket 306 pivotably, resiliently mounted in a housing 274, and a roller 258 rotatably mounted with a bolt 318 to the shorter leg portion 312 of bracket 306. Roller 258 is substantially identical to roller 58 described hereinabove. As shown in FIG. 16, housing 274 is bolted between an extends rearwardly beyond two side rails 402 and 404 which form part of the frame for assembly 244.

Figure 17:
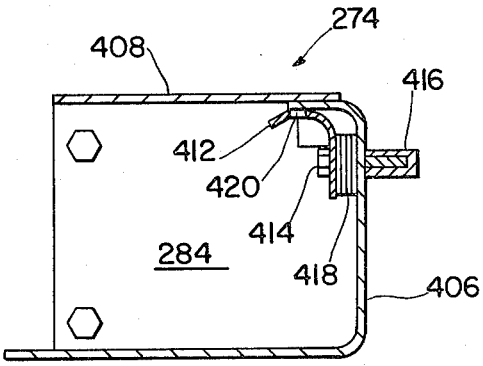
FIG. 17 is a cross-sectional view to scale, with parts removed, taken along line 17—17 in FIG. 16.

As shown in FIGS. 16 and 17, housing 274 is comprised of sides 284, an L-shaped plate 406 forming the bottom, back, and a portion of the top of housing 274, and a removable top plate 408. A bottom extension plate 410 is rigidly mounted between rails 402 and 404 and forms an extension of the bottom portion of plate 406. A rounded, elongated, L-shaped bracket 412 is adjustably, rigidly attached to the upper corner of plate 406 with two bolts 414. Bolts 414 are threaded into corresponding, internally threaded pipes 416, rigidly mounted to the back portion of plate 406. Bracket 412 is spaced the desired amount from the back portion of plate 406 by a plurality of spacers or shims 418 and has three orifices 420 through the top portion thereof. As shown in FIG. 15, top plate 408 and bottom extension plate 410 have portions cut out so that roller 258 can travel its full distance without any obstruction from housing 274.

Roller 258 and bracket 306 are shown in greater detail in FIGS. 18 and 19. In addition to shorter leg portion 312, bracket 306 also has a longer leg portion 310. The inclusive angle A between portions 312 and 310, in the depicted embodiment, is 128°, which is smaller than the angle between portions 110 and 112 of bracket 106 (FIG. 10). An upstanding plate 330, similar in construction and purpose to plate 130 in FIG. 10, is rigidly mounted at the apex between portions 312 and 310. Rigidly mounted between upstanding plate 330 and longer leg portion 310 of bracket 306 are two round staples 422.

The distal end 424 of longer leg portion 310 of bracket 306 is specially constructed so as to provide two fulcrums or pivot points when bracket 306 is pivotably mounted in assembly housing bracket 412. A rod 426 rigidly, transversely mounted at the end of longer leg portion 310 is the primary pivot point. The secondary pivot point is provided by two bars 428 rigidly mounted to either side of longer leg portion 310 and to the bottom of rod 426.

In the presently preferred embodiment, exemplary dimensions of bracket 306 are as follows. An angle B, formed by a line extending from the top of longer leg portion 310 and the end of bars 428, is 48°. The length of bracket 306 from the axis of rotation of roller 258 to the axis of rod 426 is $6\frac{5}{8}$ inches and the height of bracket 306 from the bottom of shorter leg portion 312 to the axis of rod 426 is $5\frac{3}{8}$ inches. Also, bar 428 is 1 inch wide, rod 426 has a $\frac{3}{4}$ inch diameter, and upstanding plate is $3\frac{3}{4}$ inches high.

Bracket 306 is resiliently mounted in housing bracket 412 with two coil springs 332 connected between staples 422 on bracket 306 and orifices 420 in housing bracket 412 (see FIG. 16). Bracket 306 is also provided with an elongated orifice 430 (FIG. 19) at distal end 424 so that housing bracket mounting bolt 414 does not interfere with bracket 306 as it pivots downwardly.

Thus, springs 332 force bracket 306 upwardly (clockwise direction as seen in FIG. 18) until upstanding plate 330 engages housing top 408. In this position, roller 258 is angled away from the side of a conveyor pan 36 and forms an acute angle with the vertical. On the other hand, should a misaligned conveyor pan strike the top or the side of roller 248, roller 258 will be forced downwardly against spring pressure, rotating about the primary pivot of rod 426. After a predetermined amount of rotation, the end of bar 428 will strike housing bracket 412. Further downward rotation of bracket 306 causes a disengagement of the primary pivot of rod 426 in housing bracket 412 and the engagement of the secondary pivot of the lower corner of bar 428 with housing bracket 412. Thus, the rate of extension of springs 332 is increased such that a greater return force is applied to bracket 306 per unit of additional rotation than was applied during each unit of rotation of bracket 306 about the primary pivot. It is also noted that as roller 258 and bracket 306 are rotated downwardly, the side of roller 258 will become parallel with the side of the conveyor pan striking it. Ideally, this occurs just at the changeover from the primary pivot to the secondary pivot. This added force, plus the reduced applied force from the conveyor pan edge to the side of roller 258 (when the side of roller 258 is parallel to the edge of the conveyor pan, the applied force is then only the tangential coefficient of friction between the conveyor pan and roller 258) effectively prevents any additional downward rotation of bracket 306.

With reference now to FIGS. 16 and 20, a bumper assembly 338 is depicted which also has a primary pivot and a secondary pivot. Bumper assembly 338 is comprised of a substantially rectangular open-box shaped housing 440 and a bumper 343 mounted at the forward end of housing 440 with a bolt and nut assembly 442. Housing 440 has two parallel sides 444, a front 446, a back 448, and an open top and bottom. A wire 449 is rigidly mounted to the bottom of sides 444 near the forward end thereof. Transversely, rigidly mounted at the upper rearward corner of the housing 440, along back 448, is a rod 450 which forms the primary fulcrum or pivot for bumper assembly 338. The secondary fulcrum or pivot of bumper assembly 338 is the lower, rearward end 452 of housing 440.

As shown in FIGS. 15 and 16, there is only one bumper assembly 338, and it is resiliently, pivotably mounted in bracket 412 of assembly housing 274 with an elongate coil spring 354. Coil spring 354 is connected between wire 448 of bumper assembly 338 and an orifice 420 in assembly housing bracket 412. Bumper assembly 338 is mounted higher in assembly housing 274 than roller bracket 306 and is rotated upwardly by spring 354 until the top forward end of bumper housing 338 strikes the bottom of assembly housing top 408 (see FIG. 15). The downward rotation of bumper assembly 338 is similar to that described hereinabove with respect to roller bracket 306.

A conveyor pan immobilizing assembly according to presently preferred embodiments of the invention has been set forth in great particularity hereinabove with many of its attendant advantages expressly set forth. Other advantages and objects of the present invention would be obvious to those of ordinary skill in the art. For example, if a particular conveyor had extremely accurate pan positioning, only centrally located roller assembly 104 would be required. The two bumper assemblies 138 can be easily removed from housing 74 by simply disconnecting the engaged end of their respective springs 154. Similarly, because of its modular construction, damaged parts can be easily replaced by replacing an entire bumper assembly or roller assembly. No matter how configured, the present invention provides an extremely inexpensive, quiet, efficient, trouble-free pan immobilizing assembly for securely maintaining a conveyor pan located in the loading/unloading position in an aligned position in a direction transverse to the conveyed direction yet can be easily knocked out of the way when the conveyor pan is transported in the conveyed direction.

Although the invention has been described in detail with respect to exemplary embodiments thereof, it will be understood by those of ordinary skill in the art that variations and modifications may be effected within the scope and spirit of the invention.

We claim:

1. A conveyor pan immobilizing assembly for immobilizing a conveyor pan having two opposite sides in a direction substantially perpendicular to the conveyed direction of the conveyor pan yet permitting movement of the conveyor pan in the conveyed direction, said assembly comprising first and second subassemblies mounted for respective engagement with the sides of the conveyor pan that are substantially parallel to the conveyed direction, each subassembly comprising:

a roller for engaging the pan side;

means for rotatably mounting said roller; and means for resiliently mounting said roller for movement in the substantially vertical direction, said roller being mounted such that the surface thereof when in engagement with the respective pan side forms an acute included angle with the vertical axis, said resilient mounting means comprising a housing; an elongate bracket, one end of said bracket rotatably mounting said roller and the other end of said bracket being pivotally mounted in said housing about a first pivot for a predetermined amount of rotation in a first direction and about a second pivot after continued rotation in said first direction beyond said predetermined amount of rotation; and spring means for resiliently urging said one end of said bracket in an upward direction.

2. A conveyor pan immobilizing assembly as claimed in claim 1 wherein said housing comprises a horizontally adjustable bearing means for receiving said first pivot.

3. A conveyor pan immobilizing assembly as claimed in claim 2 wherein said housing comprises a substantially vertical back and wherein said bearing means is removably mounted to said back with attachment means and a selectable number of removable shims for providing horizontal adjustment.

4. A conveyor pan immobilizing assembly as claimed in claim 2 wherein said spring means comprises an elongate extension spring, and wherein said bearing means comprises a curved plate having a top portion, a curved portion and a back portion, said plate being removably mounted to said housing at said back portion, removably receiving said first pivot in said curved portion, and having means in said top portion for mounting one end of said extension spring.

5. A conveyor pan immobilizing assembly as claimed in claim 2 wherein said spring means comprises an elongate extension spring and whereas said second pivot is located vertically lower than said first pivot and engages said housing only after said bracket is rotated downwardly a predetermined amount, and upon said engagement and further downward rotation of said bracket, said first pivot is disengaged from said bearing means and the rate of extension of said extension spring is increased such that a greater return force is applied to said bracket per unit of rotation thereof than was applied during rotation thereof about said first pivot.

6. A conveyor pan immobilizing assembly as claimed in claim 1 wherein said bracket comprises a longer first portion and a shorter second portion integrally attached thereto and forming an obtuse angle therewith, said roller being substantially perpendicularly mounted to said shorter second portion, and an upstanding member mounted on said bracket and being for engaging said housing and limiting upward pivoting of said bracket, the axis of said roller forming an acute angle with the vertical axis when said upstanding member engages said housing.

7. A conveyor pan immobilizing assembly as claimed in claim 6 wherein when said upstanding member engages said housing, the top of said roller is lower than the top surface of the conveyor pan.

* * * * *